United States Patent [19]

Jacoby

[11] 4,316,629

[45] Feb. 23, 1982

[54] HANDLED TOTE APPARATUS

[76] Inventor: Glenn C. Jacoby, 6426 N. 23rd Pl., Scottsdale, Ariz. 85253

[21] Appl. No.: 834,172

[22] Filed: Sep. 19, 1977

[51] Int. Cl.[3] ..... B66C 1/12

[52] U.S. Cl. ..... 294/152; 150/5; 220/94 R; 229/52 R

[58] Field of Search ..... 224/49, 45 P, 45 D, 224/45 E, 45 S, 48 R; 229/52 A, 52 R, 52 B, 52 AL, 54 C; 220/94 R; 16/110 R, 110.5; 150/12, 5; 294/74, 152; 190/55 R; 24/115 R

[56] References Cited

U.S. PATENT DOCUMENTS

| | | | |
|---|---|---|---|
| D. 32,491 | 2/1900 | McCarroll | 224/49 |
| 514,530 | 2/1894 | Whittemore | 150/5 |
| 926,364 | 6/1909 | Stowe | 224/49 |
| 2,319,316 | 5/1943 | Gerendas | 224/45 P |
| 2,330,684 | 9/1943 | Colling | 220/94 R |
| 2,397,433 | 3/1946 | Reeves | 224/49 |
| 3,481,519 | 12/1969 | Snetselaar | 224/49 |
| 3,692,218 | 9/1972 | Friedman | 150/12 |
| 3,779,156 | 12/1973 | Race | 224/49 |
| 3,792,806 | 2/1974 | Layton | 224/49 |
| 3,804,311 | 4/1974 | Oglesbee | 224/49 |

FOREIGN PATENT DOCUMENTS

| | | | |
|---|---|---|---|
| 1115418 | 9/1960 | Fed. Rep. of Germany | 150/12 |
| 2131131 | 3/1971 | France | 224/45 P |
| 2242949 | 4/1975 | France | 224/45 P |
| 141035 | 1/1921 | United Kingdom | 150/5 |

*Primary Examiner*—H. Grant Skaggs
*Assistant Examiner*—Kenneth Noland
*Attorney, Agent, or Firm*—Nicholas J. Aquilino

[57] ABSTRACT

One of a pair of elongate rigid handle members is carried along either lateral edge of an elongate flexible sheet. A generally cylindrical shape is imparted to the flexible sheet by a laminatively affixed reinforcing strap, which extends between the handle members. A handle structure is formed in response to engagement means detachably connecting the handle members in longitudinal juxtaposition. The apparatus is supported by angularly spaced legs extending from the sheet.

2 Claims, 14 Drawing Figures

FIG.5.
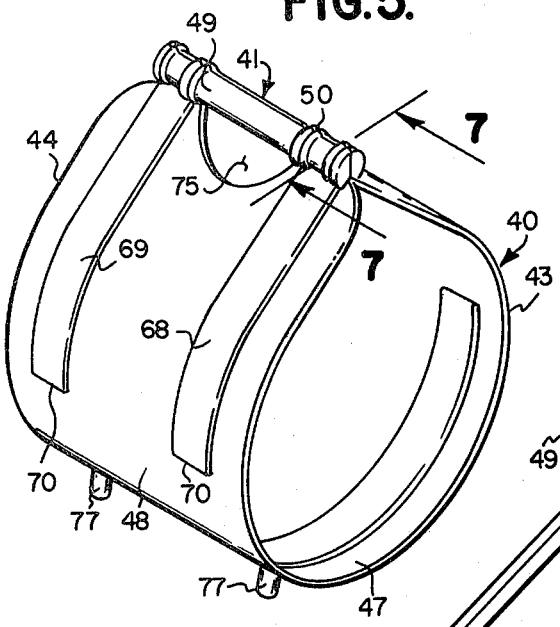
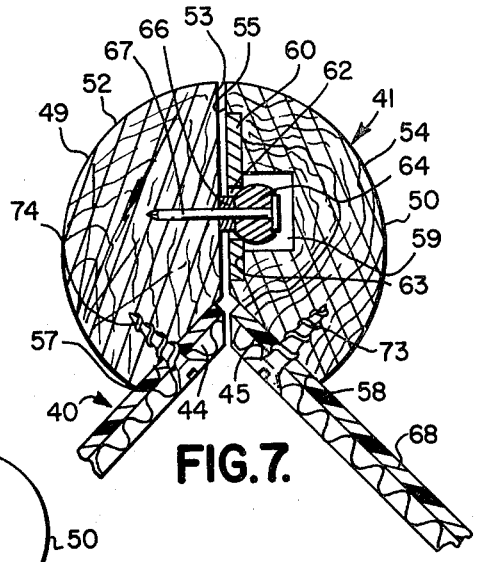
FIG.7.
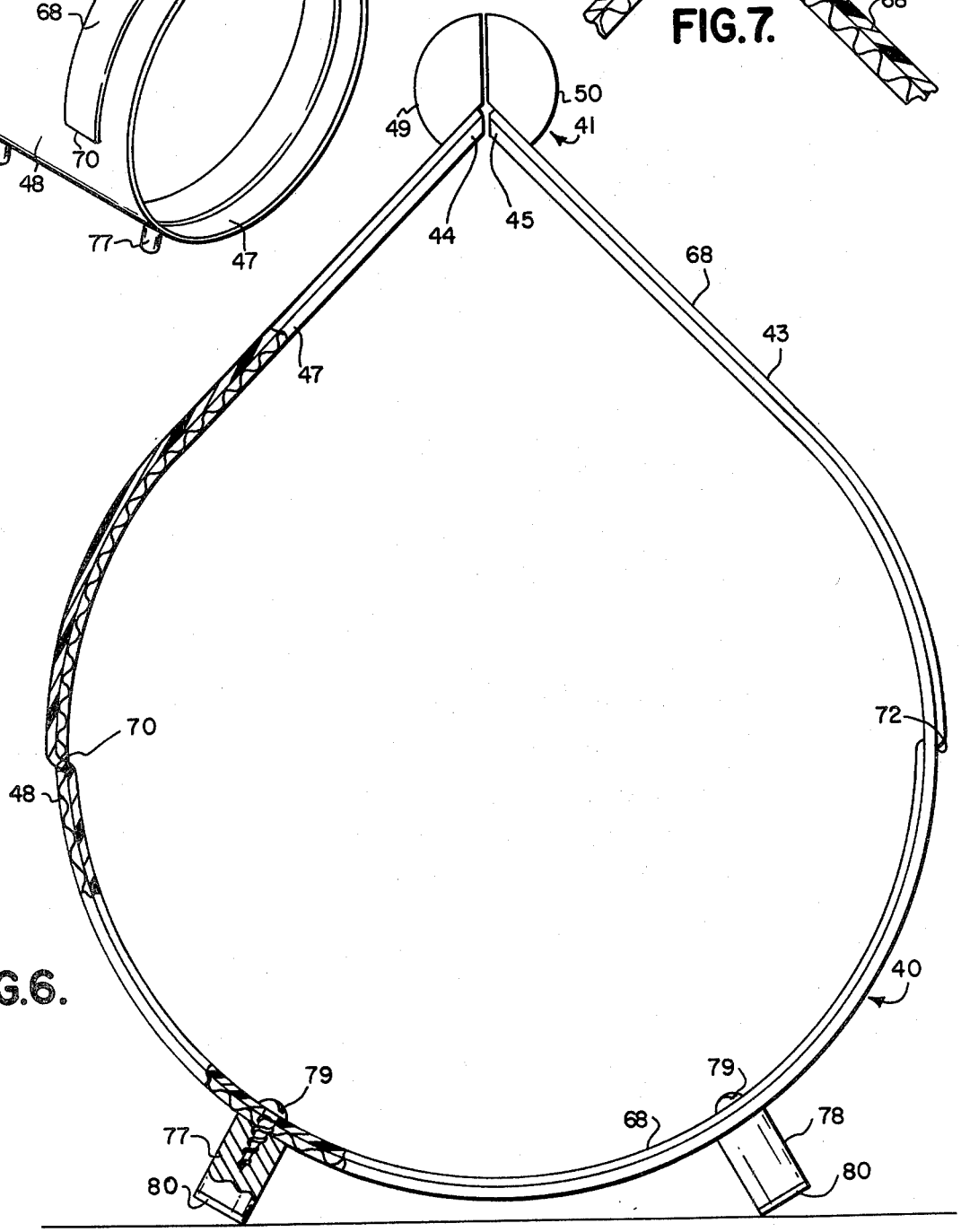
FIG.6.

HANDLED TOTE APPARATUS

This invention generally relates to apparatus for storing and transporting selected items.

More particularly, the instant invention concerns a tote apparatus having a handle for the manual lifting and carrying of a load.

In a further aspect, the present invention concerns a tote apparatus specially adapted for holding a bulk load of elongate items.

The prior art is replete with carrying devices of the type having a handle for convenience of the user. Such devices range from simple and inexpensive paper shopping bags to sophisticated and expensive personal luggage. Each has a compartment into which is placed a load of bulk items.

Carrying devices, such as luggage and attache cases, completely enclose the load and are usuall provided with catches or locks for securing a usually hingedly affixed cover member. The device is carried by a single hand grip. Other carrying devices, exemplified by shopping bags and needlework kits, have an open top and, to a limited degree, will accommodate items which extend beyond the confines of the container. Usually such devices have a pair of oppositely spaced hand grips which cooperate as a closure and as a single handle when grasped concurrently by the user.

Overlooked by the prior art are satisfactory means for manually lifting and carrying a bulk load of elongate items such as pipe or fireplace logs. Such items are generally bundled and secured with a string, wire or strap tie. Absent are any provisions for carrying. Neither are accommodations provided for storage or periodically removing one of the items. In order to extract a single item from the load, the tie must be severed and the bundle destroyed.

It would be highly advantageous, therefore, to correct the inherent limitations of the prior art.

Accordingly, it is an object of the present invention to provide an improved tote apparatus for lifting and carrying a bulk load.

Another object of the invention is the provision of a tote apparatus specially adapted for carrying extended length items.

And another object of the invention is the provision of a tote apparatus in which a plurality of elongate items can be stored and from which the items can be singularly removed.

Still, another object of this invention is to provide a tote apparatus which is flexibly yieldable with the load and yet is free standing to support the load.

A further object of the invention is the provision of an improved handle for use with flexible carrying apparatus.

And a further object of the invention is to provide a pair of handle elements which are detachably engageable to form a closure clasp and a handle structure.

Yet a further object of the invention is the provision of a handled tote apparatus which is relatively durable and easily cleaned.

And yet a further object of the instant invention is to provide a tote apparatus of the above-type which is simply constructed and readily and conveniently useable.

Briefly, to achieve the desired objectives of the present invention in accordance with a preferred embodiment thereof, first provided is an elongate flexible sheet member having first and second lateral edges. The sheet member is arcuately doubled to bring one lateral edge toward the other lateral edge. A first rigid elongate handle member extends along one lateral edge and a second rigid elongate handle member extends along the other lateral edge. Cooperating elements of a detachable connection are carried by the first and second handle members for detachably retaining the handle elements in substantially longitudinal juxtaposition as a common handle structure.

In accordance with one embodiment of the invention, a projection extends laterally from the first handle member and is received within a socket carried by the second handle element. In accordance with an alternate embodiment, the first handle member is generally cylindrical and is substantially non-deformable. The second handle member is in the form of a semi-cylindrical socket having a longitudinal opening which receives the first handle member in snap engagement.

The arcuate shape may be permanently imparted to the flexible sheet member by a relatively thin reinforcing strap laminated thereto and extending substantially from the first handle member to the second handle member. The tote apparatus may further include support means for holding the device in a substantially upright position. The support means can be in the form of a pair of angularly displaced legs secured to and extending from the reinforcing strap.

The foregoing, and further and more specific objects and advantages of the present invention, will become readily apparent to those skilled in the art from the following detailed description of preferred embodiments thereof taken in conjunction with the drawings in which:

FIG. 5 is a perspective view of an alternate embodiment of a tote apparatus embodying the principles of the instant invention;

FIG. 6 is an end elevation view of the embodiment of FIG. 5, the illustration being partly broken to illustrate further detail thereof;

FIG. 7 is an enlarged fragmentary vertical sectional view taken along the line 7—7 of FIG. 5;

Figure 1:
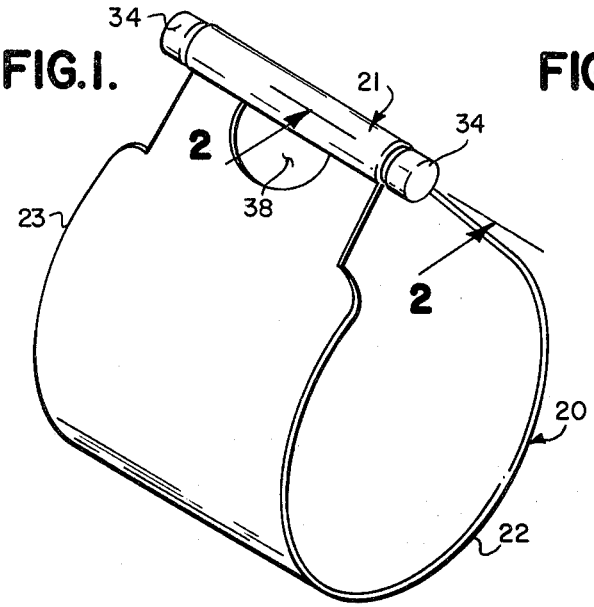
FIG. 1 is a perspective view of a tote apparatus constructed in accordance with the teachings of the present invention.

Turning now to the drawings, in which like reference characters indicate corresponding elements throughout the several views, attention is first directed to FIG. 1, which shows a tote apparatus of the instant invention including an elongate substantially flexible sheet member generally designated by the reference character 20, and a handle structure generally designated by the reference character 21. Consistent with the intended purpose, sheet member 20 is readily fabricated from various durable materials, including leather, plastic, or woven cloth such as canvas. Satisfactory test results have been achieved with a polypropylene fiber material, such as commonly used to outdoor carpeting and sold under the trade name Ozite. In general, it is preferred that a material be chosen which, in addition to having an attractive appearance, is relatively inexpensive, durable and not readily subject to deterioration or rotting from exposure to the environment.

Similarly, a material such as metal or wood, can be selected for construction of handle element 21. A particularly material exhibiting satisfactory qualities of durability and strength has been found in polyvinyl chloride commonly used in the plumbing art and generally referred to as PVC pipe.

Figure 3:
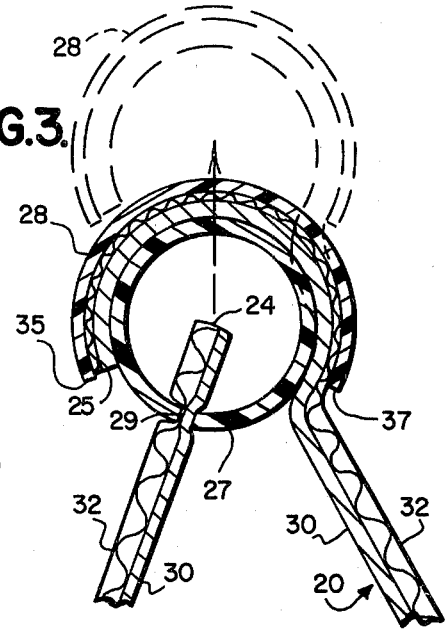
FIG. 3 is a vertical sectional view taken along the line 3—3 of FIG. 2 having an alternate position thereof superimposed in broken outline.
Figure 2:
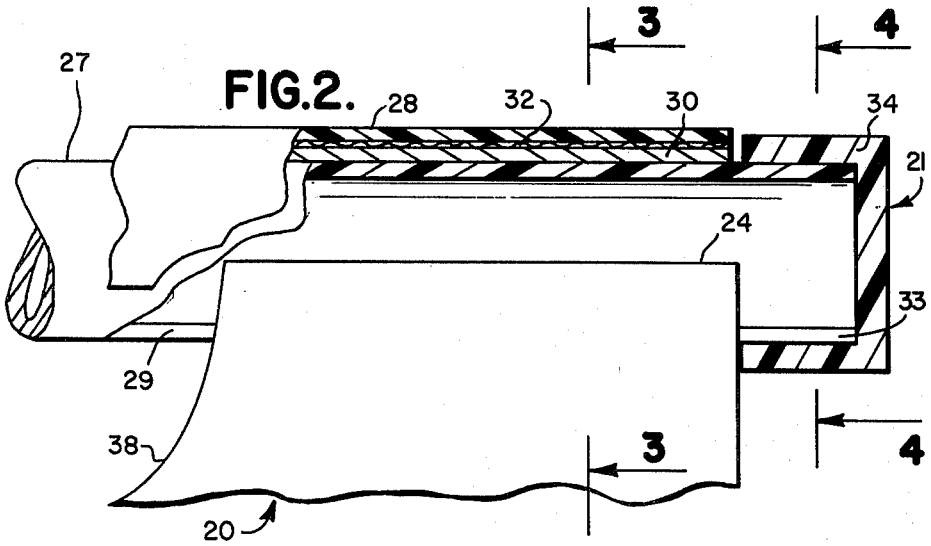
FIG. 2 is an enlarged fragmentary vertical sectional view of the tote apparatus taken along the line 2—2 of FIG. 1.
Figure 4:
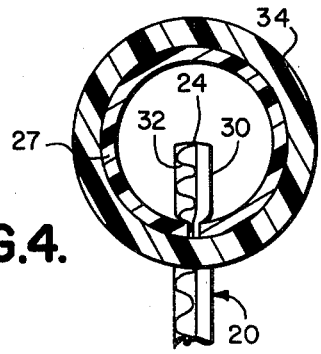
FIG. 4 is a vertical sectional view taken along the line 4—4 of FIG. 2.

Referring also to FIGS. 2, 3 and 4, it is seen that sheet member 20 has first and second spaced apart longitudinal edges 22 and 23, respectively, and first and second lateral edges 24 and 25, respectively. Sheet member 20 is arcuately doubled, bringing first lateral edge 24 in close proximity to second lateral edge 25. Handle structure 21 includes a first rigid elongate handle member 27 and a second elongate handle member 28 affixed to first and second lateral edges 24 and 25, respectively.

First handle member 27 has a longitudinal slit 29 which extends the entire length thereof. Sheet member 20, when fabricated from outdoor carpeting, has a backing 30 to which is affixed the pile, as will be readily understood by those skilled in the art. First handle element 27 is affixed to sheet member 20 proximate first lateral edge 24 by spreading slot 29 at one end thereof sufficiently to receive sheet member 30. Thereafter, sheet member 20 is drawn along handle member 27 until sheet member 20 is approximately centered relative to the length of first handle member 27.

In unstressed condition, outdoor carpeting of the type previously referenced has a thickness of approximately one-eight inch. Due to the natural resiliency of the material chosen for handle member 27, slit 29 is normally held together by substantial force. This force compresses sheet member 20 to a thickness of one thirty-second inch or less, thereby firmly affixing handle member 27 to sheet member 20. If desired, various glues and cements especially compounded for use with synthetic materials can be used to reinforce the bond, especially by providing a fillet between sheet member 20 and the interior surface of handle element 27.

End 33 of handle element 27 is finished with an externally engaged cap 34, as particularly seen in FIG. 2. The interior surface of cap 34 is moistened with an appropriate cement prior to engagement with handle member 27. Although not specifically herein illustrated, it will be appreciated that handle member 27 has a second end which is similarly finished.

Second handle element 28 is in the form of an elongate generally cylindrical socket having first and second longitudinal edges 35 and 37. An opening is defined between edges 35 and 37 which has a width less than the external diameter of first handle element 27. Therefore, when second handle element 28 is urged over first handle element 27, substantially more than one-half of the circumference of first handle element 27 is enclosed by second handle element 28 providing a secure snap engagement. A section of sheet member 20 proximate second edge 25 is laminated to the interior surface of handle member 28. It has been found that the layer of material between handle elements 27 and 28 does not affect the engagement thereof.

End caps 34 function as retainers to prevent sheet member 20 from being longitudinally displaced from handle member 27. End caps 34 also function as guides during engagement of second handle element 28 with first handle element 27, second handle element 28 having a length slightly less than the distance between end caps 34. When engaged, handle elements 27 and 28 form a handle structure by which the apparatus of the instant invention is lifted. To accommodate the handle of the user, a pair of cut-outs 38 (only one herein illustrated) are provided proximate lateral edges 24 and 25 of sheet member 20.

Attention is now directed to FIGS. 5, 6 and 7, which show an alternate embodiment of a tote apparatus embodying the teachings of the instant invention. Similar to the previously described embodiment, the immediate embodiment includes sheet member 40 and handle structure 41. Sheet member 40 has first and second longitudinal edges 42 and 43, respectively, and first and second lateral edges 44 and 45, respectively. First lateral edge 44 is brought toward second lateral edge 45, arcuately doubling sheet 40 into a substantially cylindrical configuration having internal surface 47 and external surface 48.

Handle structure 41 includes first handle member 49 and second handle member 50. Handle member 49 is semi-circular, having an arcuate surface 52 and a plane surface 53. Similarly, second handle element 50 has an arcuate surface 54 and a plane surface 55. Handle elements 49 and 50 also have beveled surfaces 57 and 58, respectively. When plane surface 53 is placed in juxtaposition with plane surface 55, handle members 49 and 50 together form substantially cylindrical handle structure 41.

Blind opening 59 is formed in second handle member 50 from surface 55. A resiliently deformable plate 60, having aperture 62 therethrough, resides in recess 63 and extends over blind opening 59. Aperture 62 is generally centrally located of blind opening 59 and the thickness of plate 60 generally corresponds to the depth of recess 63, such that plate 60 forms a continuation of plane surface 55. Plate 60 may be formed of plastic, rubber or other similar material which is resiliently yieldable.

A projection in the form of bead 64 extends laterally from surface 53. Preferably, bead 64 is non-deformable and fabricated from wood, plastic, metal, ceramic or other rigid material. Bead 64 is spaced from surface 53 by spacer 66 and is secured by nail 67 passing through bead 64 and spacer 66 and embedded into first handle member 49. Plate 60 is held within recess 63 by cement, brads or other equivilant expediencies.

Aperture 62 has an inside diameter smaller than the outside diameter of bead 64 and is sufficiently resilient to receive bead 64 therethrough. Accordingly, as plane surface 53 is brought toward plane surface 55, bead 64 is urged through aperture 62 into blind opening 59 and retaining first handle element in juxtaposition with second handle element 50 by snap engagement between bead 64 and plate 60. Handle elements 49 and 50 are readily separated in response to manual pressure. Preferably two or more projection and socket arrangements, as specifically illustrated in FIG. 7, are spaced along handle structure 41.

Alternate projection and socket arrangements are within the scope of the instant invention. For example, bead 64 can be fabricated of a resilient material, such as plastic or rubber, and sized to be frictionally received within blind opening 59. Recess 63 and plate 60 are not needed in this arrangement. Alternately, plate 60 and recess 63 can be eliminated and replaced by a resilient tubular insert carried within blind opening 59. The above embodiments are considered functionally equivilant to the embodiment specifically shown in the drawings.

A pair of reinforcing strips 68 and 69 are carried by sheet member 40 and extend between first handle member 49 and second handle member 50. Preferably, reinforcing strips 68 and 69 are relatively thin metal, such as spring temperred steel or aluminum. However, the reinforcing strips are readily fabricated from other material, such as canvas, leather and plastic, which will lend strength to the structure.

Slits 70 and 72 are formed through sheet member 40 at diametrically opposed positions. Two pair of slits 70 and 72 are spaced longitudinally along sheet member 40. Each reinforcing strap 68 and 69 is secured to beveled surface 58 of second handle element 50 by a screw 73. In accordance with the immediate embodiment as shown in FIG. 7, handle members 49 and 50 are fabricated from wood and accordingly, screw 73 is a flathead wood screw.

As particularly seen with reference to reinforcing strap 68 in FIG. 6, each strap 68 and 69 extends along the external surface 48 of sheet member 40 to slit 72. At slit 72, each reinforcing strap 68 and 69 passes through sheet member 40 and follows the contour of interior surface 47 to slit 70. The reinforcing straps 68 and 69 pass through respective slits 70 and lie in juxtaposition to external surface 48 and are finally secured to beveled surface 57 of handle member 49 by screw 74. Reinforcing straps 68 and 69 are laminated to the appropriate surfaces 47 and 48 of sheet member 40 by suitable commercially available adhesive preparations.

A similar adhesive compound is used to secure respective ends of sheet member 40 to beveled surfaces 57 and 58 along the lengths thereof on either side of reinforcing straps 68 and 69.

Similar to the previously described embodiment, sheet member 40 is cut-out as shown at 75 at each lateral edge 74 and 75 to accommodate the hand of the user in grasping handle structure 41.

Extending downwardly from the tote apparatus, as best shown in FIG. 6, are angularly displaced legs 77 and 78. Each leg 77 and 78 is generally cylindrical in shape and, as a manufacturing expediency, may be cut from a length of wooden dowel. Two legs 77 and 78 are provided. One of each is secured to each reinforcing strap 68 and 69. For purposes of attachment, round head wood screws 79 extend through the respective reinforcing strap 68 and 69 and sheet member 40 and are received in the legs 77 and 78. A pad 80, of any suitable material such as metal, rubber or the material of fabrication of sheet member 40, are secured to the free ends of each leg 77 and 78.

The purpose of reinforcing straps 68 and 69 is to add strength to sheet member 40. As such, reinforcing straps 68 and 69 may be applied to sheet member 40 in the manner described above, or alternately, slots 70 and 72 may be eliminated and reinforcing straps 68 and 69 be laminated entirely against interior surface 47 or external surface 48. Alternate methods of attaching reinforcing strips 68 and 69 to sheet member, such as by rivots, are also envisioned. It will also be appreciated that the use of a spring temperred material, such as metal or plastic, which is substantially rigid yet somewhat deformable, will impart a permanent shape to sheet member 40, yet will allow sufficient separation between handle members 49 and 50 for receiving a load.

FIGS. 8 through 12 illustrate an alternate embodiment of the invention having sheet member 82 and handle structure 83 and directly related to the embodiment previously described in connection with FIGS. 1 through 4. Sheet member 82 includes first and second longitudinal edges 84 and 85 and first and second lateral edges 87 and 88.

Handle structure 83 includes first handle member 89 and second handle member 90, each of which are analygous to previously described handle member 27. Handle element 89 is best described in connection with FIGS. 9, 10 and 11, it being understood that the ensuing description is also applicable to handle element 90. Slit 91 extends longitudinally along handle element 89 and receives sheet member 82 proximate first lateral edge 87 thereof. Sheet member 82 is secured within handle element 89 in the manner previously described in connection with handle element 87 and sheet member 20. End cap 93 is secured to end 94. A similar end cap 93 is secured to the other end of handle element 89. Second handle element 90 is similarly structured and secured to sheet member 82 proximate second lateral edge 88.

Figure 8:
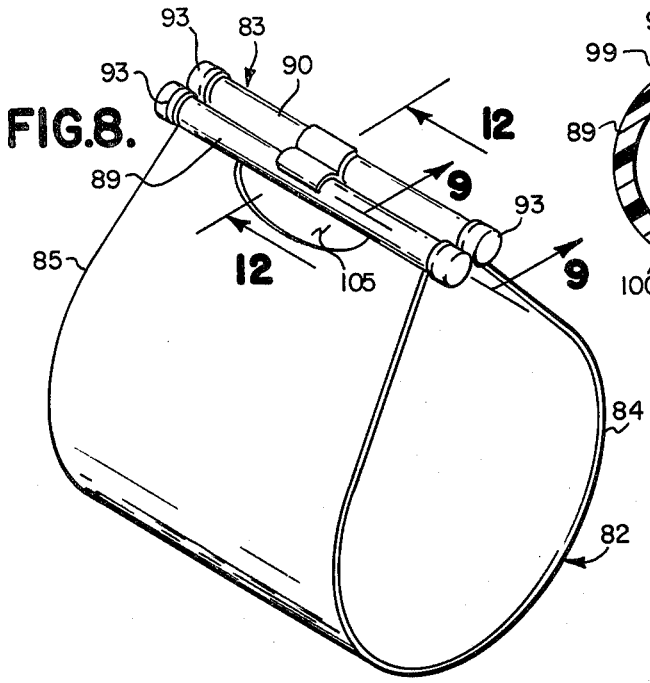
FIG. 8 is a perspective view illustrating yet another embodiment of a tote apparatus constructed in accordance with the teachings of the present invention.
Figure 12:
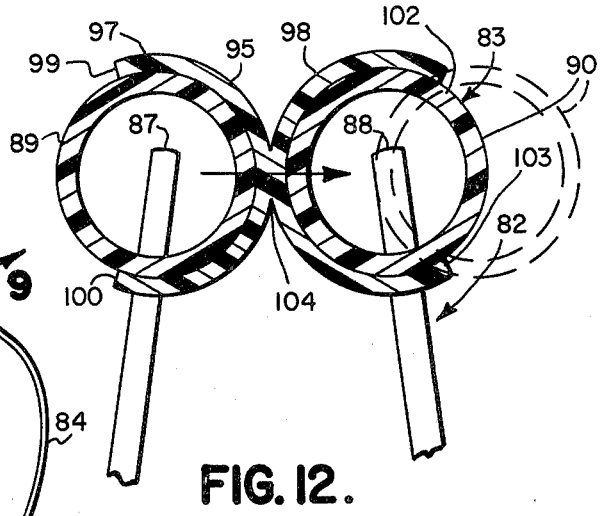
FIG. 12 is a vertical sectional view taken along the line 12—12 of FIG. 8.
Figure 9:
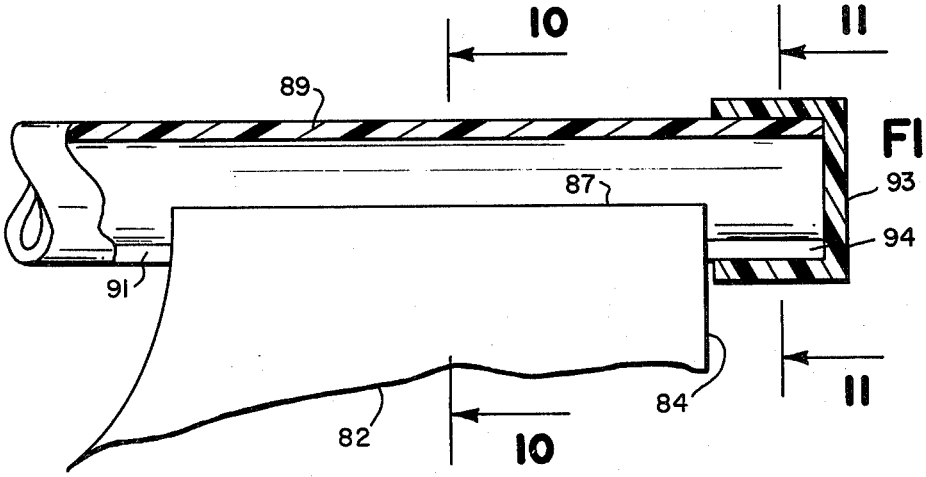
FIG. 9 is an enlarged fragmentary vertical sectional view taken along the line 9—9 of FIG. 8.
Figure 10:
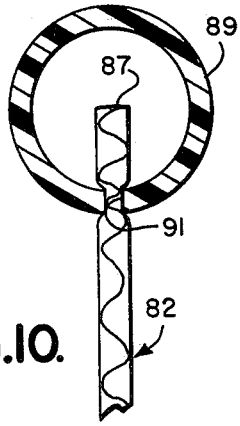
FIG. 10 is a vertical sectional view taken along the line 10—10 of FIG. 9.
Figure 11:
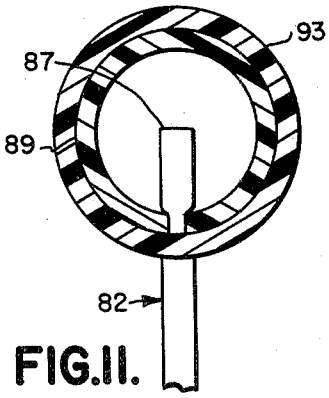
FIG. 11 is a vertical sectional view taken along the line 11—11 of FIG. 9.

As particularly illustrated in FIGS. 8 and 12, first handle element 89 and second handle element 90 are detachably engaged and held in juxtaposition by a coupling member 95 having first and second resiliently deformable socket elements 97 and 98. Socket element 97 is generally cylindrical, having an opening defined between longitudinal edges 99 and 100. The opening between edges 99 and 100 has a width dimension that is less than the diameter dimension of first handle member 89. Accordingly, handle element 89 can be received into socket element 97 by snap engagement and alternately removed by snap disengagement. Similarly, an opening is defined between longitudinal edges 102 and 103 of socket element 98, through which is received second handle member 90. Socket elements 97 and 98 are joined by a suitable bonding agent at the point of tangency indicated by reference character 104.

As above described, coupling 95 is separable from handle structure 83. Alternately, either socket element 97 or 98 can be permanently affixed to the respective handle member. In an even further modification, one of the socket elements 97 or 98 can be elminated, and the remaining socket element directly affixed to one of the handle elements to detachably receive the other. It is also noted that, similar to sheet member 20, sheet member 82 has cutouts 105 proximate each lateral edge thereof for accommodating the hand of the user.

Figure 13:
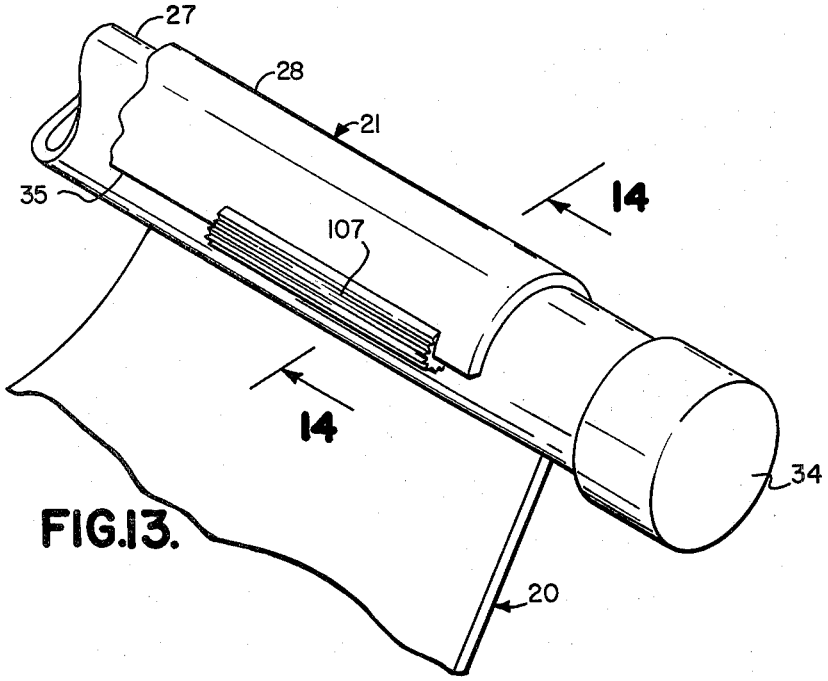
FIG. 13 is a partial perspective view of an alternate embodiment of a handle useful in connection with the tote apparatus of the instant invention.
Figure 14:
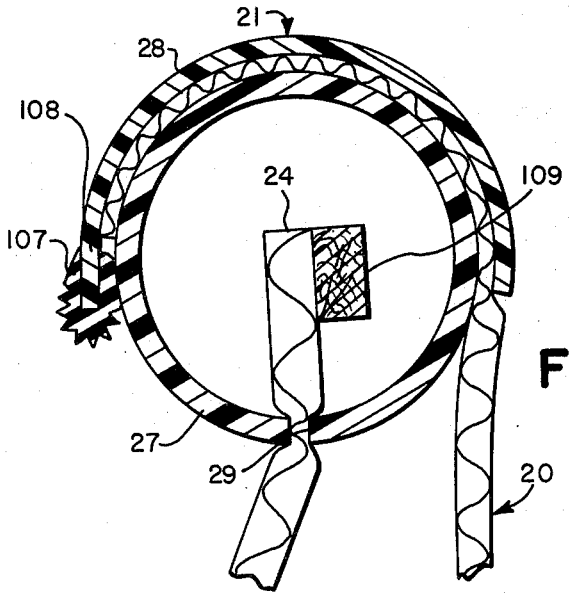
FIG. 14 is a vertical sectional view taken along the line 14—14 of FIG. 13.

FIGS. 13 and 14 illustrate a finger tab 107 attached to second handle member 28. Finger tab 107 is in the form of an elongate member of generally rigid composition, such as rubber or plastic, having a longitudinal slot 108 which receives and frictionally engages second handle element 28 along first longitudinal edge 35. In view of the relatively thin cross section of handle member 28 and the close proximity of edge 35 to handle member 27 during engagement, finger tab 107 provides additional surface area to receive a finger or thumb of the user during disengagement of the handle structure. A similar effect can be created by outwardly deforming a section of handle element 28 along edge 35.

Added resistence to pulling edge 24 of sheet member 20 from slot 29 during the lifting of exceptionally heavy loads is had by affixing reinforcing member 109 along edge 24 within handle element 27. As illustrated, reinforcing member 109 is an elongate wooden strip. An alternate embodiment thereof is immediately apparent. Fabricating second handle element 28 from a length of polyvinyl chloride pipe will result in a length of scrap which is removed to provide the opening between edges 35 and 37. The removed piece of scrap is suitable for use as the reinforcing member 109.

From the foregoing detailed description of preferred embodiments of the instant invention, it will be appreciated that the tote apparatus thereof is readily useable for lifting and carrying bulk loads of elongate items. An intended use is in combination with fireplace logs. The logs are loaded at the regular storage pile and transported to the fireplace, generally interior of a dwelling unit. The logs are stored within the tote apparatus adjacent the fireplace and are removed from the apparatus as needed. The combination of reinforcing straps and legs will support the device in an upright position. For toting pipes and similar items of excessive length, two tote apparatus can encircle a loose bundle of pipes as spaced locations. Thereafter, the bundle is readily lifted by two workmen. Due to the inherent flexibility of the sheet member, the tote apparatus will readily conform to the shape of the load.

Various changes and modifications to the specific embodiments herein chosen for purposes of illustration will readily occur to those skilled in the art. For example, sheet members may be secured to the longitudinal edges of the sheet member, adapting the device for use in storing and carrying smaller bulk items. The structure is particularly adapted for use as a shopping bag or sewing kit. Another immediately apparent modification is the lamination of the reinforcing strips entirely to the internal or external surfaces of the flexible sheet member. Further, the reinforcing strips shown in combination with only one embodiment are readily useable in combination with the other embodiment. Similarly, the handle structure is useable with any of the flexible sheet members shown, or alternately, with other sheet members at the option of the manufacturer. To the extent that such modifications and variations do not depart from the spirit of the invention, they are intended to be included within the scope thereof, which is limited only by a fair interpretation of the appended claims.

Having fully described and disclosed the present invention and alternately preferred embodiments thereof in such clear and concise terms as to enable those skilled in the art to understand the practice the same, the invention claimed is:

1. A handled tote apparatus for storing, lifting and carrying selected items comprising:

an elongated flexible sheet element having first and second spaced apart longitudinal edges and first and second lateral edges and doubled to bring said first lateral edge toward said second lateral edge for maintaining selected items therebetween;

a first substantially rigid and non-deformable elongate cylindrical handle member having an external diameter of a given dimension secured to said sheet member and extending along said first lateral edge; and a second substantially rigid elongate handle member semicylindrical along its entire length, secured to said sheet member and extending along said second lateral edge, said second handle member including a longitudinal opening having an arcuate width smaller than half its circumference, and smaller than the external diameter of said first cylindrical handle member, said second handle member forming a socket for receiving said first handle member, said second handle member being resiliently yieldable for receiving said first cylindrical handle member through said longitudinal opening in longitudinal juxtaposition with the inner surface of said second handle member so said second handle member overlies and resiliently grips said first handle member along its entire length forming a common handle structure, said first cylindrical handle member including a longitudinal slit adapted to receive the said first lateral edge of said sheet member, said sheet member further including means attached thereto and sized larger than said longitudinal slit in said first handle member to retain said lateral edge of said sheet member secured within said cylindrical handle member, said sheet member including a first cut-out along said first lateral edge adjacent said first handle member and intermediate said first and second longitudinal edges, and a second cut-out in said sheet member along said second lateral edge adjacent said second handle member and intermediate said first and second longitudinal edges, wherein said first and second cut-outs are of a shape and size sufficient to receive a human hand grasping said handle members.

2. The tote apparatus of claim 1 further including an elongate finger tab connected to said second handle member.

* * * * *